US006031433A

United States Patent [19]

Tanizaki et al.

[11] Patent Number: 6,031,433

[45] Date of Patent: Feb. 29, 2000

[54] DIELECTRIC WAVEGUIDE

[75] Inventors: Toru Tanizaki, Kyoto; Hiroshi Nishida, Kawanishi; Atsushi Saitoh, Muko, all of Japan

[73] Assignee: Murata Manufacturing Co., Ltd., Japan

[21] Appl. No.: 09/098,870

[22] Filed: Jun. 17, 1998

[30] Foreign Application Priority Data

Jun. 17, 1997 [JP] Japan ..... 9-159778

[51] Int. Cl.[7] ..... H01P 5/107; H01P 3/16

[52] U.S. Cl. ..... 333/26; 333/208; 333/219.1; 333/239; 333/248; 343/771

[58] Field of Search ..... 333/26, 208, 219.1, 333/239, 248, 250; 343/771, 785, 767, 770

[56] References Cited

U.S. PATENT DOCUMENTS 3,315,187 4/1967 Nakahara et al. ..... 333/339

5,764,116 6/1998 Ishikawa et al. ..... 333/219.1 X 5,861,782 1/1999 Saitoh ..... 333/339

*Primary Examiner*—Paul Gensler

*Attorney, Agent, or Firm*—Ostrolenk, Faber, Gerb & Soffen, LLP

[57] ABSTRACT

A dielectric waveguide which has a pair of dielectric substrates affixed to each other and a pair of electrically-conductive layers on the external surfaces of the two dielectric substrates. Each dielectric substrate has a projecting part that is thicker than other parts. A propagating region is formed where the projecting parts on the two opposing dielectric substrates are put together. Furthermore, a circuit is formed on the contact surface between the dielectric substrates. The circuit may include an electronic component. A part of the circuit is arranged in the propagating region so as to provide electromagnetic-field coupling between the circuit and the dielectric waveguide.

18 Claims, 8 Drawing Sheets

DIELECTRIC WAVEGUIDE

BACKGROUND OF THE INVENTION

1. Field of the Invention

The present invention relates to a dielectric waveguide, particularly a dielectric waveguide for use in a transmission line or an integrated circuit for the millimeter-wave band.

2. Description of the Related Art

Recently, the importance of the millimeter-wave band has increased. To achieve improvement in millimeter-wave techniques, the integrated-circuit technique is indispensable.

Various kinds of dielectric waveguides have been proposed to reduce the transmission loss of the high frequency signal in an integrated circuit. For example, a normal type dielectric line has a dielectric strip provided between two parallel electrically-conductive plates. Similarly, a grooved type dielectric waveguide has a dielectric strip provided between two electrically-conductive plates. A dielectric strip is inserted in grooves provided in the surfaces of the electrically-conductive plates. A winged type dielectric waveguide has an a pair of opposing dielectric plates, a dielectric line provided between the dielectric plates, and electrode plates deposited on the outer surfaces of the dielectric plates.

The inventors of the present invention have proposed a further new type of dielectric waveguide. The dielectric waveguide is disclosed in a laid open Japanese Patent Application No. Tokkai-Hei-9-23109. The dielectric waveguide has a dielectric strip and a circuit board both provided between two electrically-conductive plates. The circuit board may be in the vicinity of the dielectric strip to achieve electromagnetic-field coupling between a circuit element on the circuit board and the dielectric strip. Alternatively, a part of the circuit board may be inserted into the dielectric strip to achieve electromagnetic-field coupling between a circuit element on the circuit board and the dielectric strip.

However, to adjust the electromagnetic-field coupling between the circuit element and the dielectric strip, or the electromagnetic-field coupling between the dielectric strip and a strip line on the circuit board, it is necessary to locate the circuit board carefully. The same difficulty exists when locating a dielectric resonator which is to electromagnetically couple with a normal type, grooved type or winged type dielectric waveguide.

SUMMARY OF THE INVENTION

The present invention facilitates the alignment of a dielectric strip and a circuit element at the time of the assembly of a dielectric waveguide. As a result, the characteristics of manufactured dielectric waveguides can be stabilized.

According to one aspect of the present invention, a dielectric waveguide comprises a dielectric having projecting portions where the thickness of the dielectric is greater than at other portions of the dielectric, and a pair of opposing electrodes disposed on the opposite surfaces of the dielectric, wherein the projecting portions form a propagating region with the pair of opposing electrodes, and a circuit element is provided in the dielectric so as to be electromagnetically coupled with the projecting portions.

Since the circuit element may be arranged in any arbitrary position inside the dielectric, using a printing technique for example, it is unnecessary to use a circuit board to hold a circuit element in the dielectric waveguide. This contributes to a size-reduction of a dielectric waveguide.

A part of the circuit element may be a line conductor. With the line conductor in the propagating region of the dielectric waveguide, the line conductor and the pair of opposing electrodes constitute a Triplate line. Thus, a line transition is provided between the Triplate line and the dielectric waveguide.

The circuit element may be an electronic component. For example, a compact millimeter-wave circuit module can be provided by including an oscillator and a detector circuit in the dielectric waveguide.

A chamber may be provided inside the dielectric, and a dielectric resonator which projects integrally from the dielectric may be provided in the chamber. The dielectric resonator is preferably provided in the vicinity of the propagating region to cause electromagnetic-field coupling therebetween. The projecting dielectric resonator may be formed by molding for example. Since the dielectric resonator projects from the dielectric, positioning of the dielectric resonator is not necessary when assembling the dielectric waveguide.

A further dielectric resonator may be formed in the chamber, such that a dielectric filter is formed by the two dielectric resonators.

It is also possible to use such a dielectric resonator as a primary radiator of an antenna device. A slit antenna may be provided in the dielectric waveguide adjacent to the dielectric resonator.

Other features and advantages of the invention will be appreciated from the following detailed description of embodiments thereof, in which like references denote corresponding elements and part;

DETAILED DESCRIPTION OF EMBODIMENTS OF THE INVENTION

First Embodiment

Figure 1A:
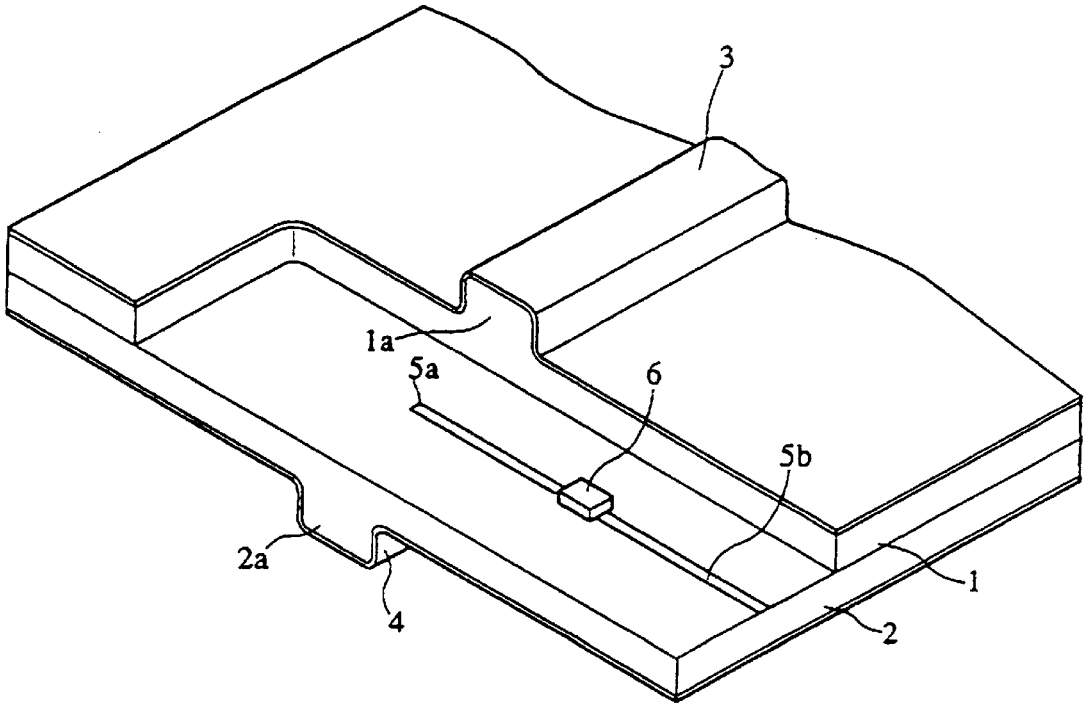
FIG. 1A is a perspective view of a dielectric waveguide according to a first aspect of the present invention wherein a part of an upper dielectric substrate is partly broken away for purposes of clarity.
Figure 1B:
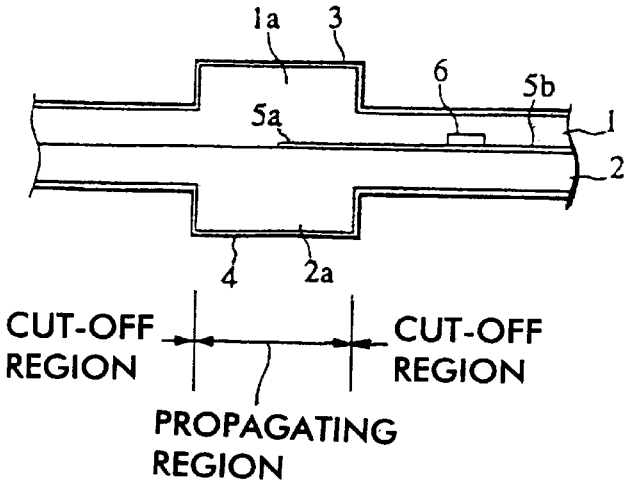
FIG. 1B is a sectional view of the dielectric waveguide of FIG. 1.
Figure 2:
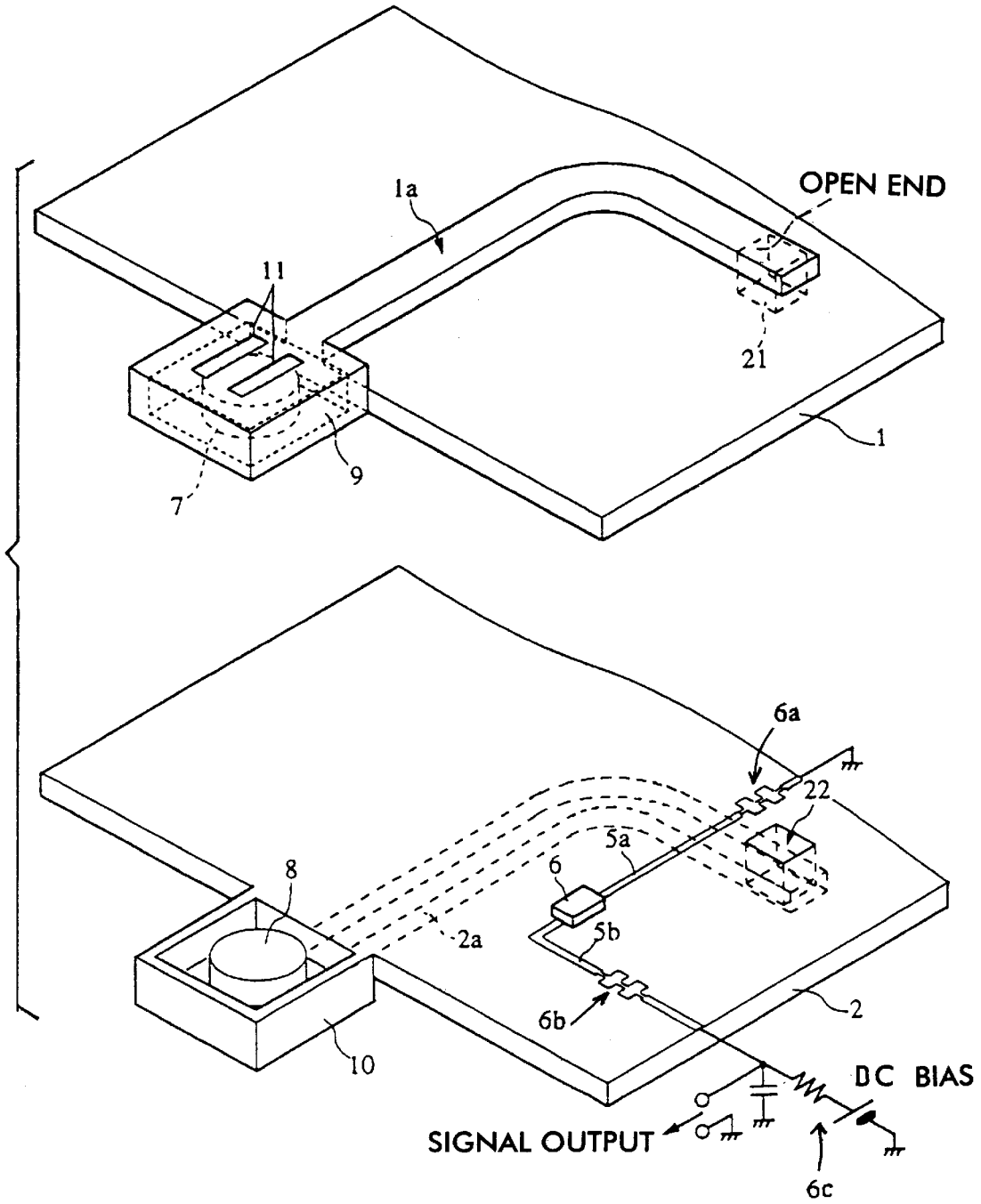
FIG. 2 is an exploded perspective view of a dielectric waveguide according to a second aspect of the present invention.

FIGS. 1A and 1B show the structure of a dielectric waveguide according to a first embodiment of the present invention. Dielectric substrates 1 and 2 are laminated. The dielectric substrates 1 and 2 have projections 1*a* and 2*a* respectively. The dielectric substrates are laminated so that the projections 1*a* and 2*a* are aligned. Electrodes 3 and 4 are provided on substantially the whole outer surface of each dielectric substrate.

The dielectric provided within and between the projections 1*a* and 2*a*, and between the pair of opposing electrodes 3 and 4, forms a propagating region. Dielectric between the pair of electrodes 3 and 4, other than in the propagating region, forms a cut-off region. Line conductors 5*a* and 5*b* may be provided on the dielectric substrate 1. Line conductor 5*a* may be extended into the propagating region. In the propagating region, the line conductor 5*a*, the electrodes 3 and 4, and the dielectric within the projections form a Triplate line.

An electronic component 6, such as a semiconductor device, may be connected to the line conductors 5*a* and 5*b*.

The dielectric waveguide may be produced by the following process for example:

Firstly, the dielectric substrate 2 is formed by molding. Any type of material such as a ceramic or a resin can be used as the dielectric. Next, a circuit pattern including the line conductors 5*a*, 5*b* and the electronic component 6 is deposited on the dielectric substrate 2. Then, the upper dielectric substrate 1 is formed by molding. Finally, electrodes 2 and 3 are deposited on the upper and lower surfaces of the dielectric substrates.

Second Embodiment

The structure of a dielectric waveguide according to a second embodiment of the present invention is explained with reference to FIGS. 2, 3, 4A and 4B. A pair of dielectric substrates 1 and 2 are laminated as shown in FIG. 3 wherein the dielectric substrates are separately shown for the sake of convenience.

Figure 3:
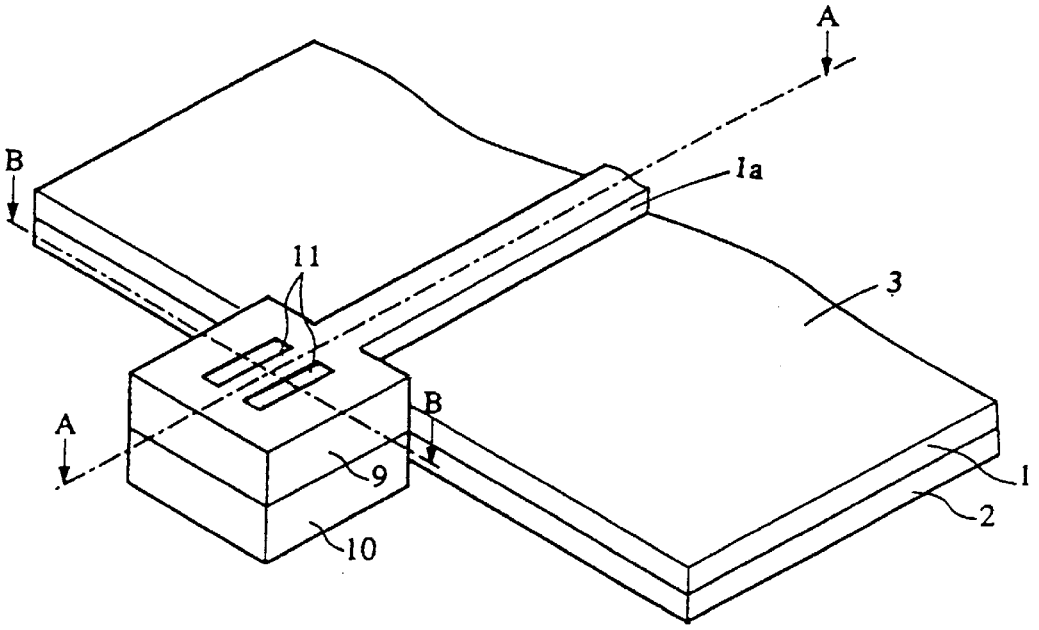
FIG. 3 is a perspective view of the dielectric waveguide of FIG. 2.
Figure 4A:
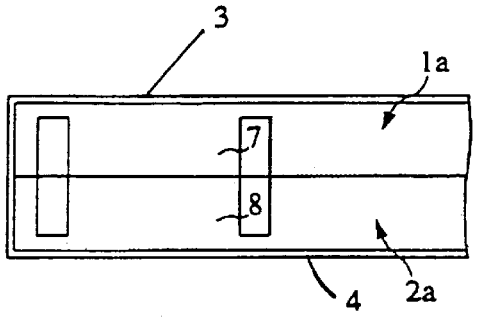
FIG. 4A is a sectional view of the dielectric waveguide of FIG. 3 taken along line A—A in FIG. 3.
Figure 4B:
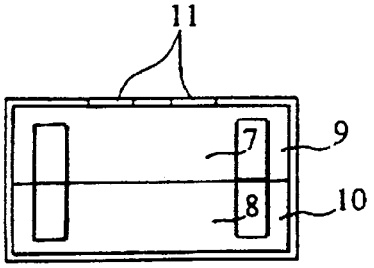
FIG. 4B is a sectional view of the dielectric waveguide of FIG. 3 taken along line B—B in FIG. 3.
Figure 5:
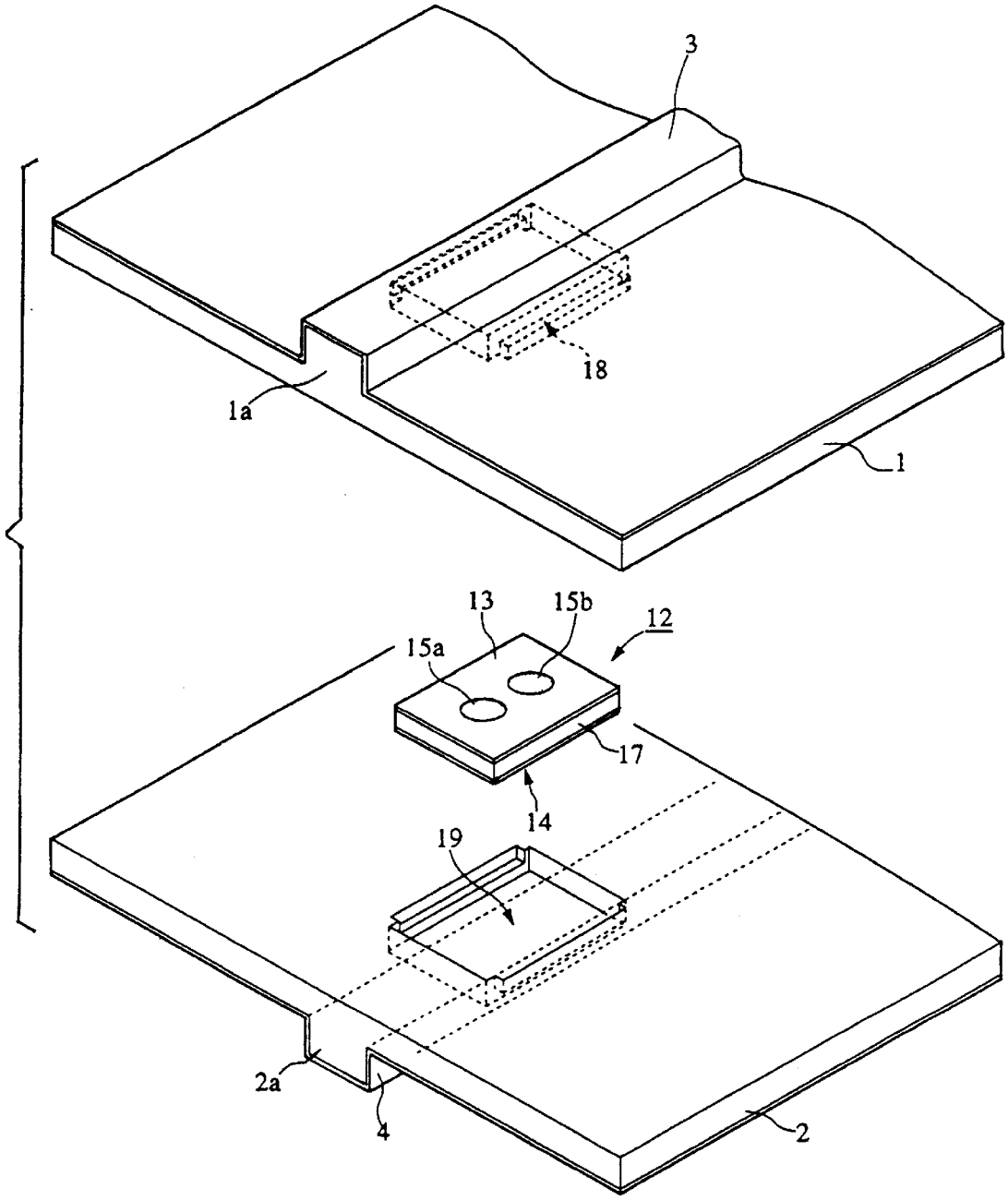
FIG. 5 is an exploded perspective view of a dielectric waveguide according to a third aspect of the present invention.

FIG. 3 shows the dielectric waveguide according to a second embodiment of the present invention. FIG. 4A is a sectional view taken along line A—A in FIG. 3. FIG. 4B is a sectional view taken along line B—B in FIG. 3.

Similar to the dielectric waveguide according to the first embodiment, the dielectric within and between the projections 1*a* and 2A (not shown), and between electrodes 3 and 4, forms a propagating region. The electrodes 3, 4 may be electrode layers formed on substantially the entire exterior surfaces of the dielectric substrates 1 and 2.

Also shown are a pair of extension parts 9 and 10 which extend respectively from the dielectric plates 1 and 2, at corresponding ends of the projections 1*a* and 2*a*. The extension parts 9 and 10 are formed at the time of producing the dielectric substrates 1 and 2 by molding for example. Also, cylinder shaped protrusions 7 and 8 are provided in the extension parts. By aligning the protrusions 7 and 8, a dielectric resonator is formed. Further, a cavity is formed, enclosing the dielectric resonator, by aligning the extension parts 9 and 10 with each other.

A pair of slots 11 are provided on the upper surface of the cavity 9. The slots 11 are defined by a pair of locations where no electrode layer is formed.

A pair of line conductors 5*a* and 5*b* are formed on the dielectric substrate 1. The line conductor 5*a* crosses the propagating region. The line conductor 5*a*, the electrodes 3 and 4, and the dielectric within and between the projections form a Triplate line. A Schottky barrier diode 6 is connected to the line conductors 5*a* and 5*b*. One end of the line conductor 5*a* is grounded via an RF filter pattern 6*a*. Another RF filter pattern 6*b* is connected to another end of the line conductor 5*b*. A DC bias circuit 6*c* is further connected to RF filter pattern 6*b*.

Hollows 21 and 22 are provided respectively near the other ends of projections 1*a* and 2*a*. When the dielectric substrates 1 and 2 are laminated, the hollows 21 and 22 are aligned to form a single chamber. A part of the propagating region is exposed within the hollows 21 and 22, and forms an open end. By adjusting the distance between the open end and the line conductor 5*a*, the electromagnetic coupling between the Triplate line and the propagating region can be adjusted.

An electromagnetic wave propagating in the dielectric waveguide is transmitted to the Schottky barrier diode 6 via the open end and the line conductor 5*a*. The electromagnetic wave is detected by the Schottky barrier diode.

The dielectric resonator formed by the protrusions 7, 8 acts as a primary radiator of an antenna. A dielectric lens may be arranged above the slot 11 to improve the directionality of the antenna. The dielectric resonator is excited by an electromagnetic wave incident to the slot 11 along the major-axis of the dielectric resonator. The resulting incidence signal is transmitted from the dielectric resonator to the dielectric waveguide and propagates through the propagating region in the LSM mode. The signal propagates to the line conductor 5*a*, and from there to the diode 6 where it can be detected.

Third Embodiment

Next, a dielectric waveguide according to a third embodiment of the present invention is explained, referring to FIGS. 5–7B. Hollows 18 and 19 are provided between the ends of a propagating region, halfway along its length in this example. An alignment of hollows 18 and 19 forms a cavity in the middle of the propagating region. A dielectric filter 12 is inserted into the cavity.

The dielectric filter 12 comprises electrodes 13 and 14 arranged respectively on the upper and lower surfaces of a dielectric substrate 17. Openings 15*a* and 15*b* are formed in the electrodes 13. Openings 16*a* and 16*b* of the same shape are provided in the electrode 17. The openings 15*a* and 16*a*, and the openings 15*b* and 16*b*, oppose respectively.

Figure 6:
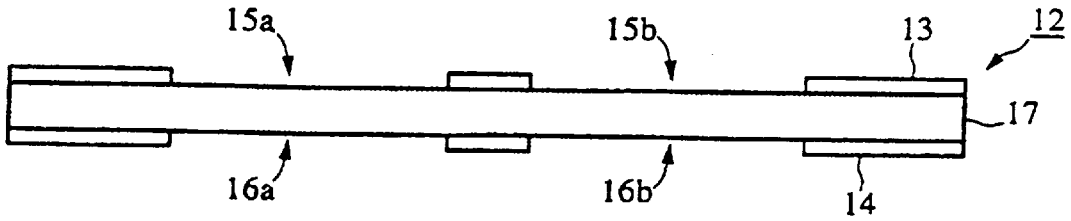
FIG. 6 is a sectional view of a dielectric filter fabricated in the dielectric waveguide of FIG. 5.
Figure 7A:
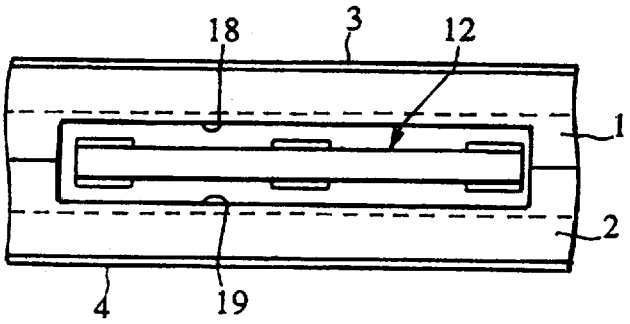
FIG. 7A is a sectional view of the dielectric waveguide of FIG. 5.
Figure 7B:
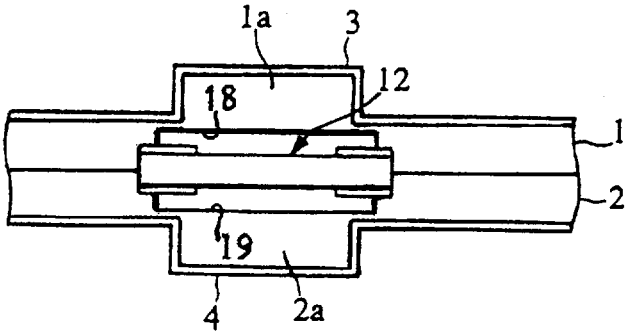
FIG. 7B is a sectional view of the dielectric waveguide of FIG. 5.

The cross section of the above-mentioned dielectric filter is shown in FIG. 6. The area between the openings 15*a* and 16*a*, and the area between the openings 15*b* and 16*b*, form respective TE010 mode dielectric resonators. As shown in FIG. 7A, the dielectric filter 12 is provided in the cavity. The dielectric substrates 1 and 2 and the dielectric resonators are isolated from each other. A pair of recesses are formed respectively in the side walls of the cavity to support the dielectric filter 12. The opposing edges of the dielectric filter 12 are supported by the corresponding recesses.

The cavity functions as a cut-off region. One of the dielectric resonators in the cut-off region electromagnetically couples with the propagating region of the dielectric waveguide. The same dielectric resonator further couples with the other dielectric resonator, which in turn also couples with the propagating region of the dielectric waveguide. In other words, the propagating regions separated by the cavity can be coupled with each other via the intervening dielectric filter 12.

Fourth Embodiment

Figure 8:
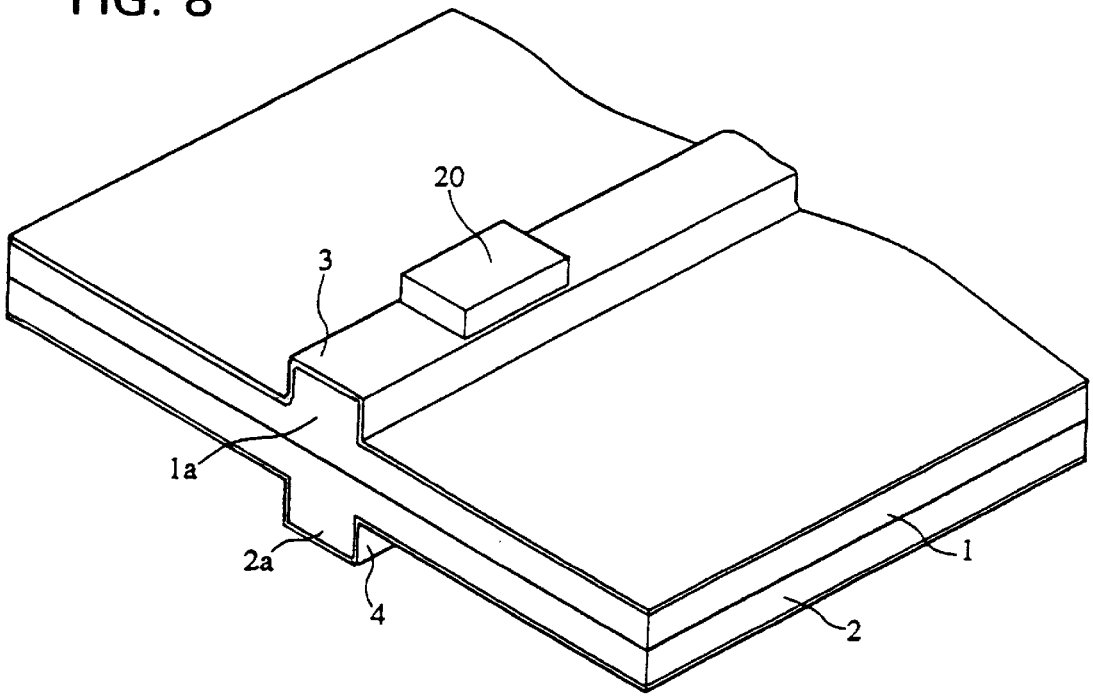
FIG. 8 is a perspective view of a dielectric waveguide according to a fourth aspect of the present invention.
Figure 9A:
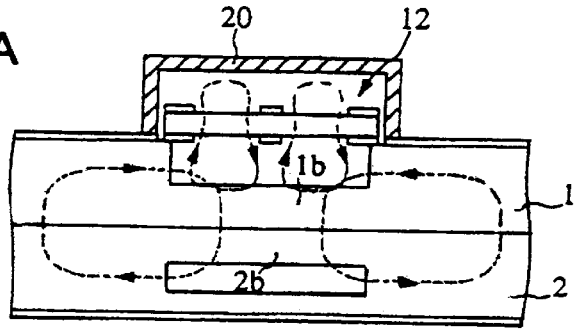
FIG. 9A and 9B are respectively longitudinal and transverse cross-sectional views of the dielectric waveguide of FIG. 8.
Figure 9B:
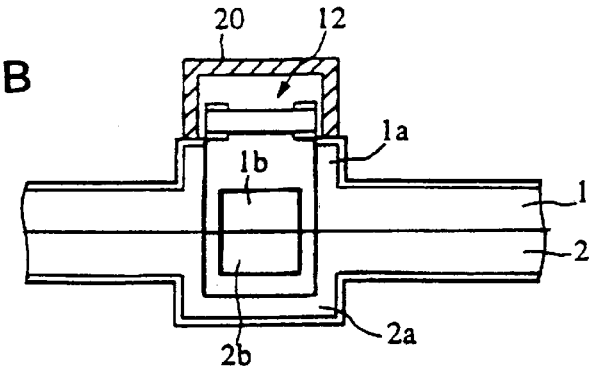

FIGS. 8, 9A and 9B show the structure of a dielectric waveguide according to a fourth embodiment of the present invention. Respective hollows are provided in part of the propagating region in each of the dielectric substrates 1 and 2. The hollows are surrounded by the projections 1*a* and 2*a* in the dielectric substrates 1 and 2. As shown in FIGS. 9A and 9B, the dielectric substrates 1 and 2 are molded so as to define dielectric rods 1*b* and 2*b*, respectively, which together form a single dielectric rod in the hollow. The opening of the hollow is covered with the dielectric filter 12 mentioned above. Furthermore, the dielectric filter 12 is covered with a metal cover 20.

The arrows in FIG. 9A show the distribution of the magnetic-field. The hollow forms a cut-off region. The propagating region and the dielectric filter 12 couple with each other. As a result, the propagating regions separated by the hollow are electromagnetically coupled with each other.

Fifth Embodiment

Figure 10:
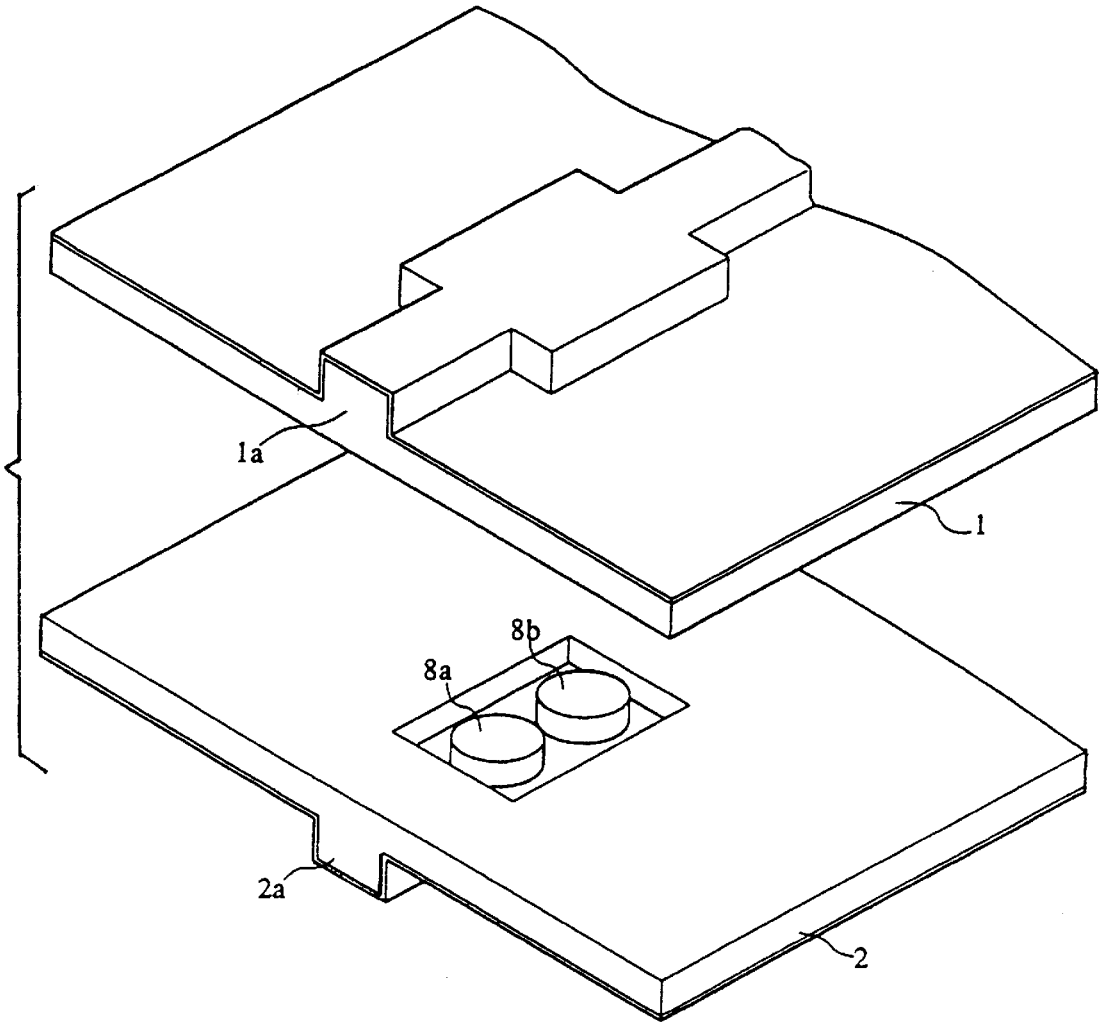
FIG. 10 is a exploded perspective view of a dielectric waveguide according to a fifth aspect of the present invention.
Figure 11:
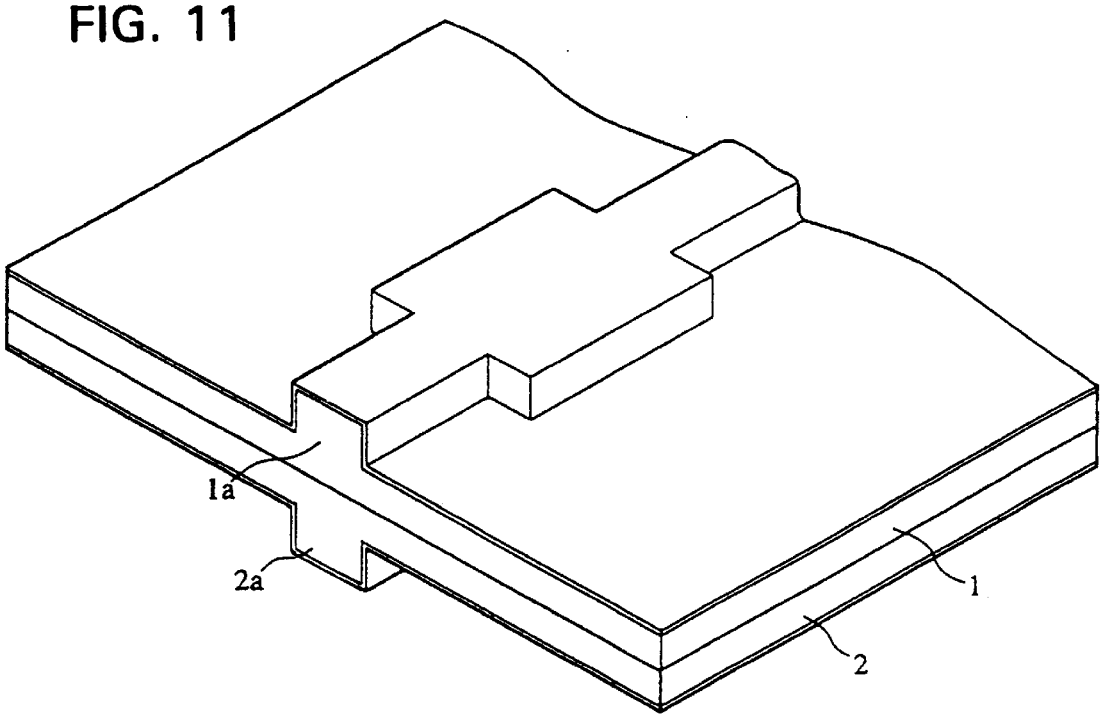
FIG. 11 is a perspective view of the dielectric waveguide of FIG. 10.

FIGS. 10–12 show the structure of a dielectric waveguide according to a fifth embodiment of the present invention.

A hollow is provided in a propagating region as in the above-mentioned examples. In the hollow, dielectric protrusions 7*a*, 7*b*, 8*a*, and 8*b* (FIG. 12A) are provided. When laminating the dielectric substrates 1 and 2, the protrusions are aligned to form respective dielectric resonators.

Figure 12A:
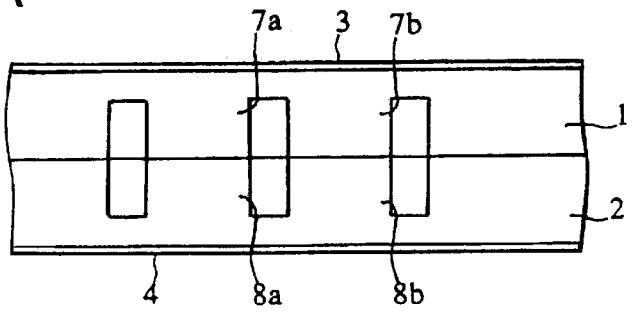
FIG. 12A and 12B are sectional views of the dielectric waveguide of FIG. 10.
Figure 12B:
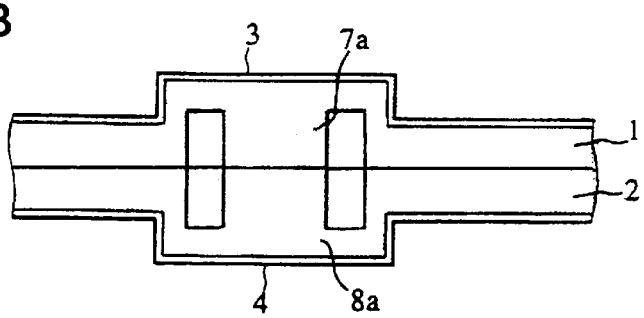

FIG. 11 is a perspective view of the assembled dielectric waveguide. FIG. 12A is a sectional view taken in a plane along the length of propagating region of FIG. 11. FIG. 12B is a sectional view taken along a plane crossing the propagating region. The dielectric resonators operate in the TE011 mode. The example shows the dielectric waveguide including a band pass filter which is formed by the two resonators.

Alternate Embodiments

By a similar technique, it is also possible to produce a dielectric waveguide which includes an amplifier or an oscillator or another type of component in the propagating region with electromagnetic coupling between the component and the dielectric waveguide.

Although embodiments of the invention have been described herein, it is to be understood that the invention is not so limited, but rather includes any modifications and variations thereof that may occur to individuals having the ordinary level of skill in the art.

What is claimed is:

1. A dielectric waveguide comprising:

an elongated dielectric which extends in a longitudinal direction having a pair of laterally projecting portions extending away from each other in a transverse direction, the thickness of the dielectric in said projecting portions being greater than at other portions of the dielectric;

a pair of opposing electrodes disposed on opposite lateral surfaces of said dielectric, said projecting portions forming a propagating region at an operating frequency with said pair of opposing electrodes said other portions of said dielectric forming a cutoff region at said operating frequency; and a circuit element embedded within said dielectric in a location for being electromagnetically coupled with said projecting portions.

2. A dielectric waveguide according to claim 1, wherein said dielectric has a hollow defined in said propagating region, said hollow being disposed for receiving said circuit element in such a location that said circuit element is electromagnetically coupled with said propagating region.

3. A dielectric waveguide according to claim 1, wherein said circuit element includes a line conductor at least a part of which is disposed in said propagating region.

4. A dielectric waveguide according to claim 3, wherein said dielectric comprises two laminated dielectric substrates.

5. A dielectric waveguide according to claim 4, wherein said circuit element is located between said laminated dielectric substrates.

6. A dielectric waveguide according to claim 5, wherein said circuit element further comprises an electronic component located between said laminated dielectric substrates.

7. A dielectric waveguide comprising:

an elongated dielectric which extends in a longitudinal direction having a pair of laterally projecting portions extending away from each other in a transverse direction, the thickness of the dielectric in said projecting portions being greater than at other portions of the dielectric;

a pair of opposing electrodes disposed on opposite lateral surfaces of said dielectric, said projecting portions forming a propagating region at an operating frequency with said pair of opposing electrodes said other portions of said dielectric forming a cutoff region at said operating frequency; and a circuit element disposed within said dielectric in a location for being electromagnetically coupled with said projecting portions;

wherein said dielectric has a hollow defined in said propagating region, said hollow being disposed for receiving said circuit element in such a location that said circuit element is electromagnetically coupled with said propagating region; and wherein said circuit element comprises a dielectric filter which is separable from said dielectric waveguide, said dielectric filter being received in said hollow.

8. A dielectric waveguide comprising:

an elongated dielectric which extends in a longitudinal direction, having a pair of laterally projecting portions extending away from each other in a transverse direction, the thickness of the dielectric in said projecting portions being greater than at other portions of the dielectric;

a pair of opposing electrodes disposed on opposite lateral surfaces of said dielectric, said projecting portions forming a propagating region at an operating frequency with said pair of opposing electrodes, said other portions of said dielectric forming a cutoff region at said operating frequency; and a circuit element disposed within said dielectric in a location for being electromagnetically coupled with said projecting portions;

wherein said dielectric has a hollow defined in said propagating region, said hollow being disposed for receiving said circuit element in such a location that said circuit element is electromagnetically coupled with said propagating region; and wherein said circuit element comprises a dielectric resonator, said dielectric resonator being disposed in said hollow.

9. A dielectric waveguide comprising:

an elongated dielectric which extends in a longitudinal direction, having a pair of laterally projecting portions extending away from each other in a transverse direction, the thickness of the dielectric in said projecting portions being greater than at other portions of the dielectric;

a pair of opposing electrodes disposed on opposite lateral surfaces of said dielectric, said projecting portions forming a propagating region at an operating frequency with said pair of opposing electrodes, said other portions of said dielectric forming a cutoff region at said operating frequency; and a circuit element disposed within said dielectric in a location for being electromagnetically coupled with said projecting portions;

wherein said dielectric has a hollow defined in said propagating region, said hollow being disposed for receiving said circuit element in such a location that said circuit element is electromagnetically coupled with said propagating region; and wherein said dielectric comprises two laminated dielectric substrates, said hollow being defined by a pair of adjacent hollow portions defined respectively in said two laminated dielectric substrates.

10. A dielectric waveguide comprising:

an elongated dielectric which extends in a longitudinal direction, having a pair of laterally projecting portions extending away from each other in a transverse direction, the thickness of the dielectric in said projecting portions being greater than at other portions of the dielectric;

a pair of opposing electrodes disposed on opposite lateral surfaces of said dielectric, said projecting portions forming a propagating region at an operating frequency with said pair of opposing electrodes, said other portions of said dielectric forming a cutoff region at said operating frequency; and a circuit element disposed within said dielectric in a location for being electromagnetically coupled with said projecting portions; wherein:

a chamber is defined within said dielectric, said chamber being located in said propagating region; and a first dielectric resonator is disposed in said chamber, said dielectric resonator protruding integrally from said dielectric and into said chamber.

11. A dielectric waveguide according to claim 10, wherein a slot antenna is defined in said dielectric adjacent to said dielectric resonator.

12. A dielectric waveguide according to claim 11, wherein said circuit element includes a line conductor at least a part of which is disposed in said propagating region.

13. A dielectric waveguide according to claim 12, wherein said circuit element further comprises an electronic component connected to said line conductor.

14. A dielectric waveguide according to claim 10, further comprising a second dielectric resonator disposed in said chamber, said second dielectric resonator protruding integrally from said dielectric and into said chamber, said second dielectric resonator being electromagnetically coupled with said first resonator so that said first and second resonators form a filter.

15. A dielectric waveguide comprising:

two laminated dielectric substrates;

outer electrodes disposed respectively on outer surfaces of said laminated dielectric substrates;

a pair of projecting portions protruding respectively from said laminated dielectric substrates to form a propagating region at an operating frequency with said outer electrodes, wherein other portions of said dielectric substrates form a cut-off region at said operating frequency; and a circuit pattern formed directly on an inner surface of at least one of said two laminated dielectric substrates.

16. A dielectric waveguide according to claim 15, wherein said circuit pattern forms a Triplate line with said outer electrodes, and wherein said Triplate line couples with said dielectric waveguide.

17. A dielectric waveguide according to claim 15, further comprising:

an electronic component disposed on said inner surface of said at least one of said two laminated dielectric substrates, and connected with said circuit pattern.

18. A dielectric waveguide comprising:

two laminated dielectric substrates;

outer electrodes disposed respectively on outer surfaces of said laminated dielectric substrates;

a pair of projecting portions protruding respectively from said laminated dielectric substrates to form a propagating region at an operating frequency with said outer electrodes, wherein other portions of said dielectric substrates form a cut-off region at said operating frequency;

a circuit pattern disposed on an inner surface of at least one of said two laminated dielectric substrates; and a dielectric resonator protruding integrally from said dielectric and electromagnetically coupled with said dielectric waveguide.

* * * * *